US010077892B2

(12) United States Patent
Li

(10) Patent No.: US 10,077,892 B2
(45) Date of Patent: Sep. 18, 2018

(54) PACKAGING STRUCTURE FOR LED LAMP HAVING INSERT ROD

(71) Applicant: Feng Li, Guangdong (CN)

(72) Inventor: Feng Li, Guangdong (CN)

( * ) Notice: Subject to any disclaimer, the term of this patent is extended or adjusted under 35 U.S.C. 154(b) by 0 days.

(21) Appl. No.: 15/310,767

(22) PCT Filed: May 18, 2015

(86) PCT No.: PCT/CN2015/000333

§ 371 (c)(1),
(2) Date: Nov. 13, 2016

(87) PCT Pub. No.: WO2016/179722

PCT Pub. Date: Nov. 17, 2016

(65) Prior Publication Data

US 2018/0119933 A1 May 3, 2018

(30) Foreign Application Priority Data

May 8, 2015 (CN) ..... 2015 1 0233763

(51) Int. Cl.

| | |
|---|---|
| ***F21V 17/10*** | (2006.01) |
| ***F21V 15/01*** | (2006.01) |
| ***F21V 21/08*** | (2006.01) |
| ***F21V 19/00*** | (2006.01) |
| *F21S 2/00* | (2016.01) |

(52) U.S. Cl.
CPC ..... *F21V 21/0808* (2013.01); *F21V 15/01* (2013.01); *F21V 17/10* (2013.01); *F21V 19/002* (2013.01); *F21S 2/00* (2013.01)

(58) Field of Classification Search
CPC .. F21S 2/00; F21V 19/00; F21V 17/00; F21V 17/10; F21V 21/21; F21V 21/12
See application file for complete search history.

(56) References Cited

U.S. PATENT DOCUMENTS 6,707,678 B2 * 3/2004 Kobayashi ..... H05K 5/0052 361/752

* cited by examiner

*Primary Examiner* — Karabi Guharay

(57) ABSTRACT

A packaging structure for an LED lamp contains: a casing, a substrate, a printed circuit board (PCB), and at least one locking element. The casing, the PCB, and the substrate are stacked and adhered together. The at least one locking element respectively inserts into and retains with two connection gaps between the casing and the substrate so as to fix the casing and the substrate together. The substrate includes a stepped groove defined on a central portion thereof and facing the casing, and the stepped groove of the substrate has a first accommodation part and a second accommodation part. A size, a profile, and a depth of the first accommodation part correspond to a size, a profile, and a thickness of the casing. A size, a profile, and a depth of the second accommodation part correspond to a size, a profile, and a thickness of the PCB.

3 Claims, 2 Drawing Sheets

PACKAGING STRUCTURE FOR LED LAMP HAVING INSERT ROD

FIELD OF THE INVENTION

The present invention relates to a light-emitting diode (LED) lamp, and more particularly to a packaging structure which fixes a casing and a substrate of the LED lamp together.

BACKGROUND OF THE INVENTION

A conventional packaging structure for a light-emitting diode (LED) lamp is capable of fixing a casing and a substrate of the LED lamp together. The LED lamp contains a lens, multiple LED chips, a printed circuit board (PCB), a substrate, a heat dissipator, and a casing which are fixed together in an adhering manner, a locking manner and a screwing manner, thus causing complicated fixing process.

The present invention has arisen to mitigate and/or obviate the afore-described disadvantages.

SUMMARY OF THE INVENTION

The primary objective of the present invention is to provide a packaging structure which fixes a casing and a substrate of an LED lamp securely and easily.

To obtain above-mentioned objective, a packaging structure for an LED lamp provided by the present invention contains: a casing, a substrate, a printed circuit board (PCB), and at least one locking element.

The casing, the PCB, and the substrate are stacked and adhered together.

The at least one locking element respectively inserts into and retains with two connection gaps between the casing and the substrate so as to fix the casing and the substrate together.

Preferably, the substrate includes a stepped groove defined on a central portion thereof and facing the casing, and the stepped groove of the substrate has a first accommodation part and a second accommodation part, wherein a size, a profile, and a depth of the first accommodation part correspond to a size, a profile, and a thickness of the casing. A size, a profile, and a depth of the second accommodation part correspond to a size, a profile, and a thickness of the PCB.

Preferably, the first accommodation part of the substrate houses the casing, and the second accommodation part of the substrate houses the PCB.

Preferably, a peripheral side of the casing contacts with an inner wall of the first accommodation part so as to form the two connection gaps between the casing and the substrate, and a retaining slot is arranged on each of the two connection gaps between the casing and the substrate, wherein the retaining slot has a first locking part defined on the peripheral side of the casing and has a second locking part formed on the inner wall of the first accommodation part.

Preferably, a cross section of the retaining slot is circular, and a cross section of said each locking element is circular, wherein a diameter of said each locking element corresponds to that of the cross section of the retaining slot.

Preferably, said each locking element inserts into and retains with the retaining slot.

In another preferred embodiment, a packaging structure for an LED lamp provided by the present invention contains: a casing, a substrate, a printed circuit board (PCB), and at least one locking element.

The casing, the PCB, and the substrate are stacked and adhered together.

The substrate includes a dented groove defined on a central portion thereof and includes a connection holder arranged on one end thereof.

The PCB and the casing are housed in the dented groove of the substrate, and a fixing structure is arranged on the one end of the substrate beside two sides of the connection holder.

The fixing structure includes the at least one locking element and at least one retaining slot defined by the casing and the substrate, wherein a peripheral side of the casing contacts with an inner wall of the substrate so as to form the at least one retaining slot, and each of the at least one locking element is inserted into each of at least one retaining slot.

Preferably, a cross section of said each retaining slot is circular, and a cross section of said each locking element is circular, hence said each locking element inserts into and retains with said each retaining slot.

DETAILED DESCRIPTION OF THE PREFERRED EMBODIMENTS

Figure 1:
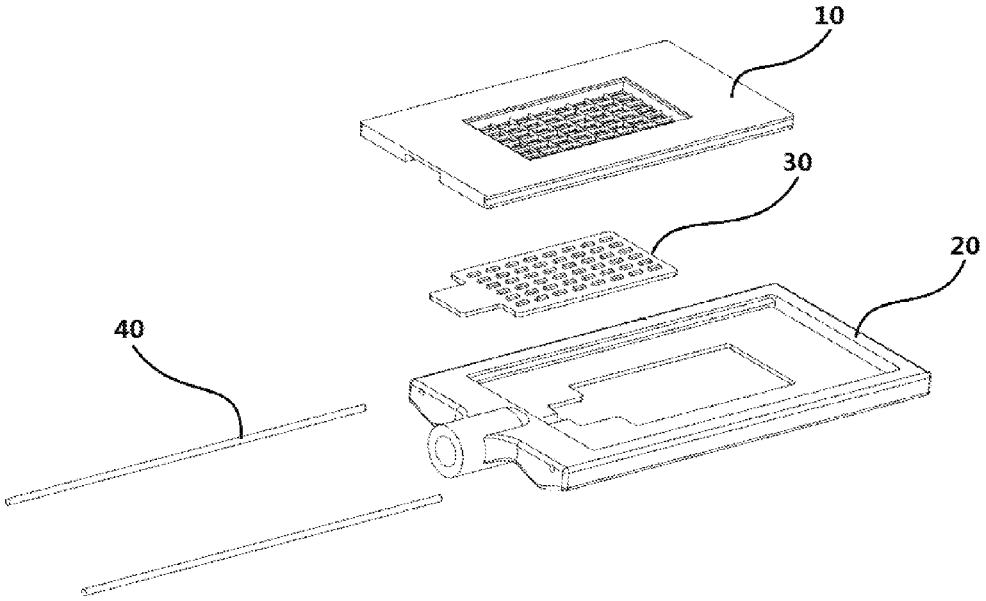
FIG. 1 is a perspective view showing the exploded components of a packaging structure for an LED lamp according to a first embodiment of the present invention.

With reference to FIG. 1, a packaging structure for a light-emitting diode (LED) lamp according to a first embodiment of the present invention comprises: a cover 10, a substrate 20, a printed circuit board (PCB) 30, and two insert rods 40.

The cover 10, the PCB 30, and the substrate 20 are stacked and adhered together, wherein the substrate 20 accommodates the PCB 30 and the cover 10, the PCB 30 includes a plurality of light-emitting diode (LED) chips arranged thereon so as to illuminate lights via the cover 10, and the cover 10 is configured to cover the PCB 30 and to dissipate heat from the plurality of LED chips of the PCB 30. The two inserts rods 40 are respectively inserted into and retain with two connection gaps between the cover 10 and the substrate 20 s as to fix the cover 10 and the substrate 20 together.

Figure 3:
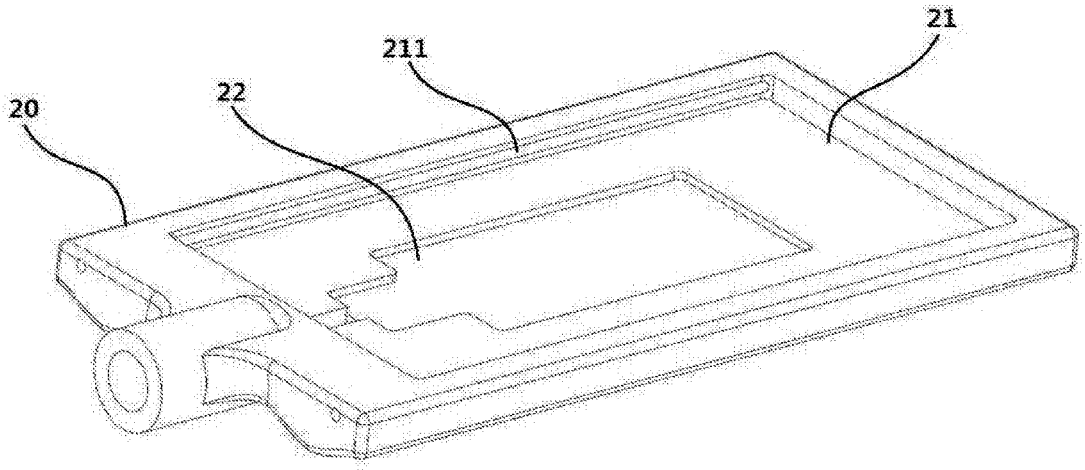
FIG. 3 is a perspective view showing the assembly of a part of the packaging structure for the LED lamp according to the first embodiment of the present invention.

As shown in FIG. 3, the substrate 20 includes a stepped groove defined on a central portion thereof and facing the cover 10, such that the stepped groove of the substrate 20 accommodates the PCB 30 and the cover 10. The stepped groove of the substrate 20 has a first recess 21 and a second recess 22. A size, a profile, and a depth of the first recess 21 correspond to a size, a profile, and a thickness of the cover 10 so that the first recess 21 houses the cover 10. A size, a profile, and a depth of the second recess 22 correspond to a size, a profile, and a thickness of the PCB 30 so that the second recess 22 houses the PCB 30. In other words, a depth between a bottom of the second recess 22 and a bottom of the first accommodation 21 is equal to a thickness of the PCB 30, and a depth between the bottom of the first accommodation 21 and a top of the substrate 20 is equal to a thickness of the cover 10.

Preferably, when the cover 10 covers the PCB 30 housed in the second recess 22, the cover 10 contacts with the first accommodation 21 so that the plurality of chips arranged on the PCB 30 are not pressed by the cover 10.

In assembly, the PCB 30 is housed in the second recess 22, and the cover 10 is covered on and contacts with the first accommodations portion 21, then the two insert rods 40 are respectively inserted into and retains with the two connection gaps between the cover 10 and the substrate 20, thus fixing the cover 10 and the substrate 20 together.

Figure 2:
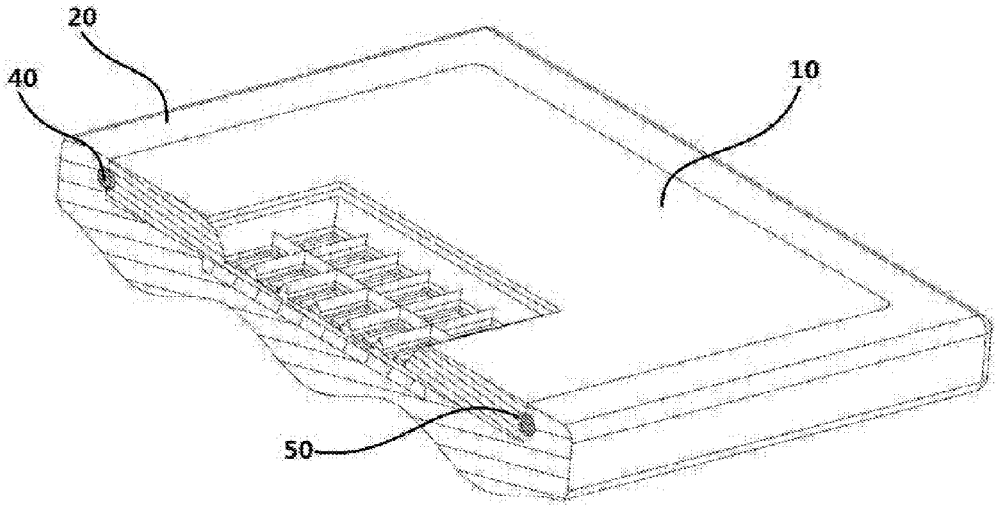
FIG. 2 is a cross sectional perspective view showing the assembly of a part of the packaging structure for the LED lamp according to the first embodiment of the present invention.
Figure 4:
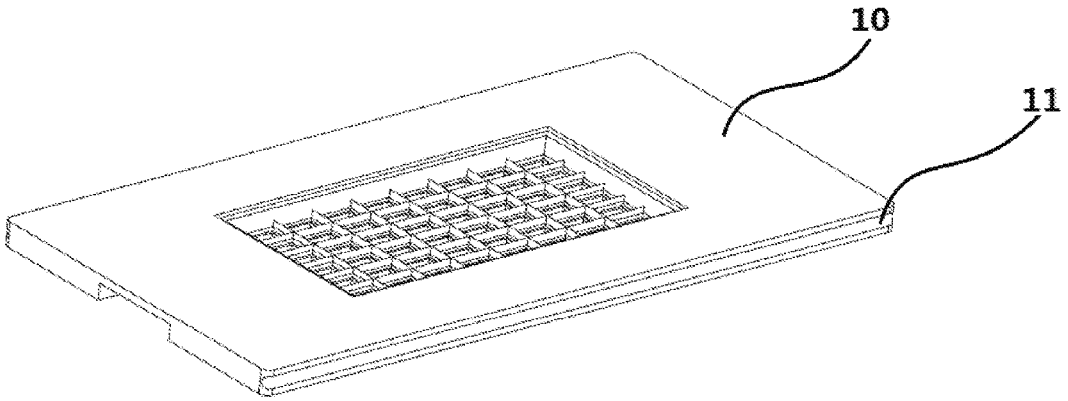
FIG. 4 is another perspective view showing the assembly of a part of the packaging structure for the LED lamp according to the first embodiment of the present invention.

Referring to FIGS. 2 and 4, a peripheral side of the cover 10 contacts with an inner wall of the first recess 21 so as to form the two connection gaps between the cover 10 and the substrate 20, and a channel 50 is arranged on each of the two connection gaps between the cover 10 and the substrate 20, wherein the channel 50 has a first trench 11 defined on the peripheral side of the cover 10 and has a second trench 211 formed on the inner wall of the first recess 21, such that each of the two insert rods 40 is inserted into and retains with the channel 50, thus fixing the cover 10 and the substrate 20.

In this embodiment, a cross section of the channel 50 is circular, each of the first trench 11 and the second trench 211 is semicircular, and a cross section of said each insert rod 40 is circular, wherein a diameter of said each insert rod 40 corresponds to that of the cross section of the channel 50. Accordingly, the first trench 11 and the second trench 211 are produced easily, and said each insert rod 40 inserted into and retains with the channel 50 securely and quickly.

In a second embodiment, a packaging structure for a light-emitting diode (LED) lamp according to a second embodiment of the present invention comprises: a cover 10 in a rectangle shape, a substrate 20 in a rectangle shape, a printed circuit board (PCB) 30, and at least one insert rod 40.

The cover 10, the PCB 30, and the substrate 20 are stacked and adhered together, wherein the substrate 20 includes a dented groove defined on a central portion thereof and includes a connection holder arranged on one end thereof. The PCB 30 and the cover 10 are housed in the dented groove, and a fixing structure is arranged on the one end of the substrate 20 beside two sides of the connection holder so as to avoid interference of an electric wire which connects with a power source and the PCB 30. Thereby, the fixing structure fixes the cover 10 and the substrate 20 securely.

The fixing structure includes the at least one insert rod 40 and at least one channel 50 defined by the cover 10 and the substrate, wherein the cover 10 is accommodated and retains in the dented groove, a peripheral side of the cover 10 contacts with an inner wall of the substrate so as to form the at least one channel 50, and each of the at least one channel 50 has two trenches 11, 211 configured to accommodate each of the at least one insert rod 40, hence the cover 10 and the substrate 20 are fixed tightly by the fixing structure.

A cross section of each of the at least one channel 50 is circular, and a cross section of said each insert rod 40 is circular.

Accordingly, the cover 10, the PCB 30, and the substrate 20 are fixed easily and securely.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A packaging structure for an LED lamp comprising:

a substrate, having a first recess and a second recess, the second recess being located in and deeper than the first recess, wherein an edge of the first recess is formed with a first trench;

a printed circuit board (PCB), having a plurality of light-emitting diode (LED) chips mounted thereon, and received in the second recess;

a cover, being light-permeable, having a shape and size corresponding to the first recess, and fittingly embedded in the first recess, wherein an edge of the cover is formed with a second trench corresponding to the first trench in shape and position, and both the first and second trenches correspondingly combine to form a channel; and an insert rod, inserted into the channel to fix the cover to the substrate.

2. The packaging structure as claimed in claim 1, wherein a planar size of the PCB is not greater than that of the cover.

3. The packaging structure as claimed in claim 1, wherein a cross section of the channel is circular, and a cross section of said insert rod is circular, and a diameter of said rod fittingly corresponds to that of the cross section of the channel.

* * * * *